United States Patent [19]

Nied et al.

[11] Patent Number: 4,786,406

[45] Date of Patent: Nov. 22, 1988

[54] PARTICLE CLASSIFIER WITH WEAR-RESISTANT CLASSIFIER WHEEL

[75] Inventors: Roland Nied, Bonstetten; Ekkehart Illigner, Augsburg, both of Fed. Rep. of Germany

[73] Assignee: Alpine Aktiengesellschaft, Augsburg, Fed. Rep. of Germany

[21] Appl. No.: 838,990

[22] Filed: Mar. 12, 1986

[30] Foreign Application Priority Data

Mar. 13, 1985 [DE] Fed. Rep. of Germany ..... 3508889

[51] Int. Cl.[4] ..... B07B 7/08

[52] U.S. Cl. ..... 209/139.1; 209/143; 209/144; 209/154

[58] Field of Search ..... 209/139.2, 139.1, 134, 209/136, 138, 664, 674, 680, 683, 144, 154, 143, 132; 403/167, 168

[56] References Cited

U.S. PATENT DOCUMENTS

| | | | |
|---|---|---|---|
| 2,100,734 | 11/1937 | Crites | 209/140 X |
| 2,269,412 | 1/1942 | Sturtevant | 209/144 |
| 3,269,537 | 8/1966 | Kaiser | 209/144 |
| 3,384,238 | 5/1986 | Alpha | 209/144 |
| 4,124,321 | 11/1978 | Hutchins | 403/167 |
| 4,388,183 | 6/1983 | Thomas | 209/148 X |
| 4,528,091 | 7/1985 | Nied et al. | 209/139.2 |
| 4,570,545 | 2/1986 | Sherrow | 403/167 X |

FOREIGN PATENT DOCUMENTS 927876 6/1963 United Kingdom .

OTHER PUBLICATIONS

Standard Handbook for Mechanical Engineers–Baumeister, pp. 177–178, McGraw Hill, 7th Ed.

*Primary Examiner*—Robert B. Reeves
*Assistant Examiner*—Donald T. Hajec
*Attorney, Agent, or Firm*—Pennie & Edmonds

[57] ABSTRACT

A particle classifier and in particular a particle classifier wheel where the blades are made entirely of a wear-resistant material such as sintered corundum. The blades extend between two discs and are mounted therebetween to have some axial play. The ends of the blades fit into annular grooves formed in the two discs and rubbery-elastic inserts are provided to hold the blades in place.

10 Claims, 2 Drawing Sheets

PARTICLE CLASSIFIER WITH WEAR-RESISTANT CLASSIFIER WHEEL

BACKGROUND OF THE INVENTION

1. Field of the Invention

The invention relates to an apparatus for classifying particles and in particular to an apparatus for separating particles smaller than a given size from a mixture of particles and air.

2. Description of the Related Art

A classifier of the type described herein is an air classifier with a rotating classifier wheel similar to that shown in U.S. Pat. No. 4,528,091. The carrier air with particles entrained therein passes through blades of the classifier wheel to the inside of the wheel. The air flows from the outside of the wheel to the inside in a counter-centrifugal direction. The blades are positioned in a crown arrangement with their elongated dimension extending parallel to the axis of rotation of the wheel. The blades are fixed with their first ends inserted in recesses in a circular disc mounted on the classifier wheel hub. The second end of the blades are mounted in an annular shroud disc.

The classifier usually has a housing with a vertical axis. The housing has a cylindrical upper portion which contains the classifier wheel or wheels. The housing has a funnel shaped lower portion to direct the oversized particles downward.

The material to be classified is fed into the classifier together with the carrying air, as shown in British patent No. 927,876. Alternatively, the material and carrying air may be introduced into the classifier separately as shown in German patent No. 17 57 582. In either version the coarse material is withdrawn through a bottom opening in the lower portion of the housing, and the finer material is entrained in the carrying air and travels through the classifier wheel and out an outlet stack emerging from the classifier near its top.

Air classifiers of this type are compact and simple to operate. Even when used with material that is difficult to classify, selective classification can be achieved down to a range below 10 μm in grain size while maintaining the fine material free from, oversized granules. The separation limit which can be achieved depends on the circumferential speed of the classifier wheel. The smaller the desired separation limit is, the higher the rotational speed of the classifier wheel must be. However, as the rotational speed of the classifier wheel increases, the wear on the component parts of the classifier wheel also rapidly increases. The increased wear through abrasion causes an increased level of impurities in the finished product from the abraded pieces of the wheel. In relation to normal quantities of product throughput, such impurities are relatively slight and can generally be tolerated. This is not the case when high purity or highly abrasive material is handled. In the case of high purity materials, such as fluorescent substances, ceramic materials, materials for dental prosthesis and the like, even a small amount of impurities renders the product unusable. In the case of abrasive materials, such as those having a Mohs hardness of four or more, the rapidly moving components of the classifier wheel, and particularly the blades, are subject to intense wear. Economical operation of the classifier is therefore not possible when classification of such material is necessary.

It is known to coat surfaces subject to the danger of wear with a wear-resistant ceramic material, for example, in spiral fluid-energy mills. Coated parts, however, cannot be used where they will be subjected to tensile or bending stresses. Such stresses will cause material cracking due to the difference in modulus of elasticity between the support material and the coating material. Parts coated with ceramic material are consequently not suitable for use as classifier wheel blades.

SUMMARY OF THE INVENTION

It is an object of the present invention to improve on the above-described air classifier. The improvement permits treatment of high purity or highly abrasive material.

Surprisingly, it has been found that blades manufactured entirely from wear-resistant ceramic material are suitable for use in classifier wheels. The preferred material is sintered corundum, though other materials such as zirconium oxide and the like are also suitable. Sintered corundum with a Mohs hardness of over nine is characterized by outstanding resistance to wear together with good mechanical-strength properties and relative ease of manufacture.

The blades are braced with their ends in the circular mounting disc and shroud disc respectively. The blades are mounted without any appreciable clamping forces yet are securely mounted. Toward this result, it is advantageous to support the ends of the blades in inserts made of a rubbery elastic material. Wear-resistant polyurethane is ideal for this purpose. In the most basic embodiment the inserts are forged as rings having radial slots cut into their outer periphery for receiving the blades.

The surfaces of the circular hub disc, shroud disc and other parts which come into contact with the material being classified are subject to a lesser amount of dynamic stress than the blades of the classifier wheel and may be coated in a known manner with a wear resistant ceramic material. In this manner abrasive wear is reduced to a minimum.

As a further means of reducing wear or abrasion on the classifier wheel, the diameter of the opening in the shroud disc for the passage of carrying air and fine material is made approximately 40% of the outer diameter of the classifier wheel. In other words, the opening is reduced by approximately 60% of the outer diameter of the classifier wheel as compared to the standard design. Within the annular space from the inner rim of the blades of the classifier wheel to the circumference of the opening in the shroud disc, the laws pertaining to downward eddy flow are applicable. The separation limit of the classifier wheel depends substantially on the circumferential velocity of the classifying flow at the edge of the opening. The reduction in the opening diameter therefore carries with it a lowering of the separation limit. This is because as the whirling remains constant, the circumferential velocity of the carrying flow increases at the edge of the opening. The change in the separation limit takes place in a manner inversely proportional to the change in diameter of the opening. If the classifier wheel is to provide the original separation limit at a smaller diameter opening then a reduction in the rotational speed of the wheel is necessary, this lower speed further reduces the wear on the wheel. The reduced spin also reduces wear of the guiding parts which carry off the carrying air and fine material.

DESCRIPTION OF THE PREFERRED EMBODIMENT

Figure 1:
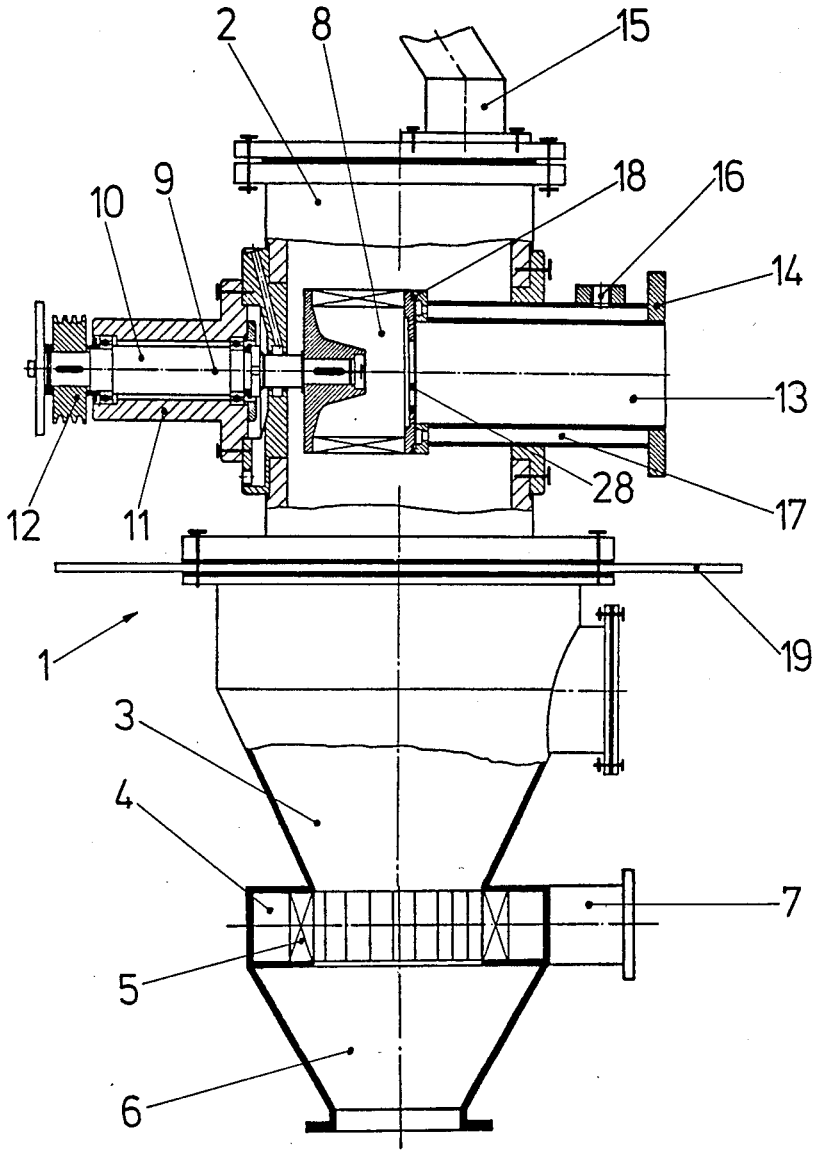
FIG. 1 is a longitudinal cross-section through a classifier with the classifier wheel of the invention.

Referring to FIG. 1, there is shown an air classifier 1 having a vertical axis. The housing has an upper cylindrical portion 2 and funnel-shaped lower portion 3. In order to improve the degree of effectiveness of the classification, there is provided a cylindrical receptacle 4 which provides re-classification of the coarse material which is discharged from the funnel-shaped lower portion 3. The cylindrical receptacle 4 has guide vanes 5 and a discharge hopper 6 for discharge of the coarse material. Carrying air is admitted through carrying air intake 7 which opens tangentially into cylindrical receptacle 4.

The classifier wheel 8 is adapted for rotation about a horizontal axis 9 and is disposed in upper portion 2. The classifier wheel 8 is mounted on shaft 10. Shaft 10 is in turn carried by a bearing housing 11 and is driven by a motor (not shown) by means of pulley 12. The bearing housing 11 is secured laterally to the upper portion 2. A discharge port 28 is provided in classifier wheel 8 for carrying air laden with fine material. The discharge port 28 opens into double walled tube 13 having a flange 14 for connecting to a trap (not shown) which catches the fine material.

The path of the entering carrying air is determined by vertically oriented guide vanes 5. During operation of the classifier 1, an air-tight discharge member such as a cell sluice (not shown) is secured to the flange at the bottom of discharge hopper 6 for collecting coarse material which is separated out and falls toward the bottom.

The material to be classified is fed in by a metering device through the duct 15. The connecting piece 16 and the outer chamber 17 of the tube 13 serve for the admission of scavenging air into the gap between the classifier wheel 8 and the flange 18 of tube 13. Upper portion 2 and lower portion 3 are screwed to the mounting plate 19 through which the air classifier 1 can be secured to a frame, trestle or other similar member.

Figure 2:
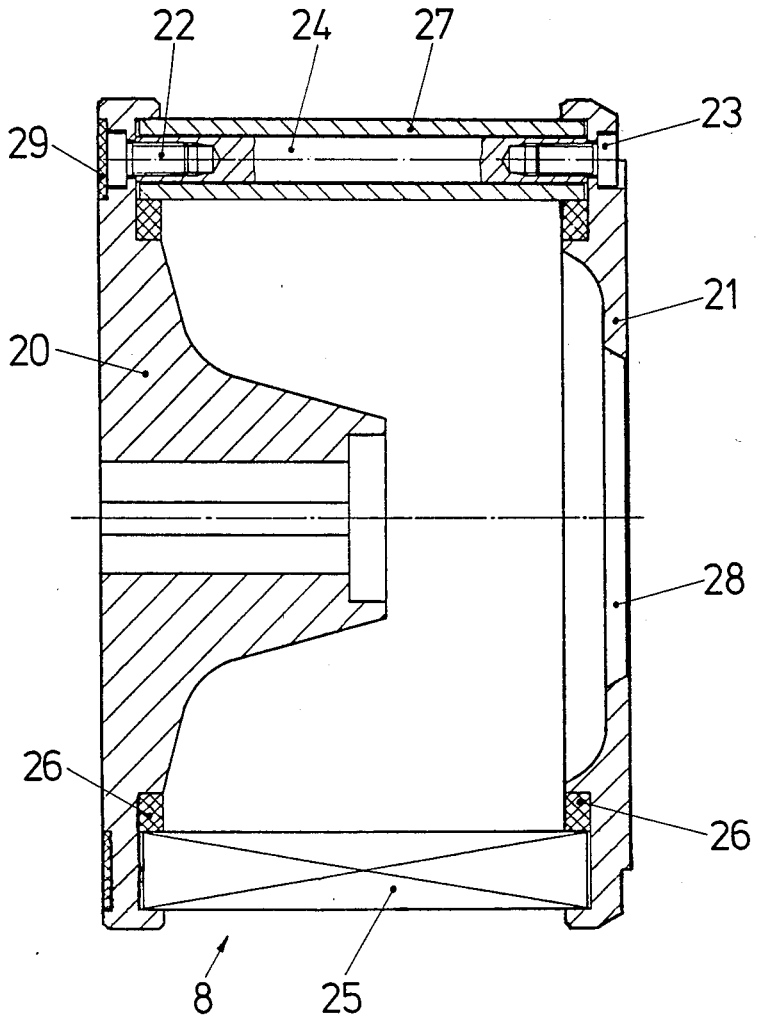
FIG. 2 is a longitudinal cross-section of the classifier wheel of the invention.

Now referring to FIG. 2 the classifier wheel 8 is shown in greater detail. The wheel includes disc 20 which supports the classifier hub. Also included is shroud disc 21. The axial distance between the two discs is determined by distance bolts 24 held by screws 22, 23. The discs mount sintered corundum blades 25. The ends of the blades 25 fit in annular recesses in the two discs. The blades are mounted so they have some axial play in the recesses. Rings 26 made of rubbery elastic, wear resistant material are fitted into the recesses. Rings 26 have slots formed in their outer periphery. The slots receive and secure blades 25 in position and brace them radially against the circular disc 20 and shroud disc 21.

For protection against wear, the distance bolts 24 are surrounded by sleeves 27 made of sintered corundum which, like blades 25, have axial play. The sleeves 27 rest their ends in suitable recesses in rings 26. All the surfaces of the circular disc 20 and the shroud disc 21 which come into contact with the material to be classified are coated with a wear resistant ceramic material. The diaphragmatically designed discharge port 28 in the shroud disc 21 has a diameter which amounts to only about forty percent of the diameter determined by the outer edge of blades 25, which are arranged in a crown. To protect the screws 22, a ring 29 made of the same material as the rings 26 is set into the circular disc 20.

We claim:

1. A rotating wheel for an air classifier through which air carried particles flow from outside said wheel to inside said wheel, comprising:
   (a) a plurality of blades made entirely of wear resistant ceramic in a crown arrangement running parallel to the axis of rotation of said wheel;
   (b) a first disc at a first end of said blades carrying a hub for the classifier wheel;
   (c) a second disc defining a central opening for use as an annular shroud disc located at a second end of said blades;
   (d) distance bolts positioned between said first and second discs in order to maintain said first and second discs at a predetermined distance of separation;
   (e) recesses defined by said first and second shroud disc for receiving and holding opposite ends of said blades without exertion of substantial axial forces on the blades, axial play between said blades and said discs being provided; and
   (f) rubbery-elastic, wear resistant inserts disposed in said recesses to radially support said blades between said first and second disc.

2. The air classifier wheel according to claim 1 wherein:
   (a) the wear resistant ceramic material is sintered corundum.

3. The air classifier wheel according to claim 1 wherein:
   (a) said inserts are formed of a wear-resistant polyurethane.

4. The air classifier wheel according to claim 1 wherein:
   (a) sleeves made of wear resistant material surround said distance bolts; and
   (b) said sleeves are mounted on said distance bolts between said first and second discs with axial play between said sleeves and said discs.

5. The air classifier wheel according to claim 1 wherein:
   (a) a wear-resistant covering is disposed on the surfaces of the first and second discs which are exposed to the material being classified.

6. The air classifier wheel according to claim 1 wherein:
   (a) said central opening in said second disc is a central exit opening and the diameter of said exit opening is 40% of the diameter of the classifier wheel as measured to the outer edge of the blades.

7. In a classifier wheel for a particle classifier comprising a first disc for holding a classifier wheel hub, a second disc which is annular to provide an exit opening for the removal of carrying air and entrained particles, a plurality of distance bolts for maintaining a predetermined distance between said first and second discs, and a plurality of blades positioned between and spaced about the circumference of said first and second disc, the improvement wherein:
   (a) said blades are made of wear resistant material;
   (b) said first and second discs define annular grooves for receiving the ends of said blades;

(c) said blades are mounted between said first and second discs to provide axial play between said blades and said discs; and (d) rubbery-elastic inserts having radial slots are provided in said grooves to bias said blades axially in said grooves and thereby secure the blades in position.

8. The improved classifier wheel of claim 7 wherein:

(a) said blades are made of sintered corundum.

9. The improved classifier wheel of claim 7 wherein:

(a) said distance bolts are disposed within protective sleeves of wear resistant material; and, (b) said sleeves are of such a length to be provided with some axial play when positioned on said distance bolts.

10. The improved classifier wheel of claim 7 wherein:

(a) said first and second discs have surfaces which are exposed to the particles being classified and said surfaces are coated with sintered corundum.

* * * * *